US009957719B2

(12) United States Patent
Wiborg et al.

(10) Patent No.: US 9,957,719 B2
(45) Date of Patent: May 1, 2018

(54) MODULAR, EASY-INSTALL WINDOW SHADING SYSTEM

(71) Applicants: David Emerson Wiborg, Newton, MA (US); Dmitri Menn, Marblehead, MA (US); Kevin Dutt, Newton Center, MA (US)

(72) Inventors: David Emerson Wiborg, Newton, MA (US); Dmitri Menn, Marblehead, MA (US); Kevin Dutt, Newton Center, MA (US)

( * ) Notice: Subject to any disclaimer, the term of this patent is extended or adjusted under 35 U.S.C. 154(b) by 0 days. days.

(21) Appl. No.: 14/827,039

(22) Filed: Aug. 14, 2015

(65) Prior Publication Data

US 2016/0076254 A1 Mar. 17, 2016

Related U.S. Application Data

(60) Provisional application No. 62/037,508, filed on Aug. 14, 2014.

(51) Int. Cl.
*E04F 10/08* (2006.01)

(52) U.S. Cl.
CPC ..... *E04F 10/08* (2013.01)

(58) Field of Classification Search
CPC .. E04F 10/08; E04F 10/10; E06B 7/08–7/092
See application file for complete search history.

(56) References Cited

U.S. PATENT DOCUMENTS 1,941,308 A * 12/1933 Indahl ..... E04F 10/08 160/29
2,136,012 A * 11/1938 Jones ..... E04F 10/10 160/20
2,503,492 A * 4/1950 Jones ..... E04F 10/08 52/78
3,039,155 A * 6/1962 Iacovoni ..... E06B 7/082 160/104
4,208,846 A * 6/1980 Griebel ..... E04F 10/08 52/667
4,251,966 A * 2/1981 Foltman ..... E06B 9/04 52/309.1
4,258,464 A * 3/1981 Ullman, Jr. ..... A47B 57/22 144/220
5,024,409 A * 6/1991 Bohnen ..... A63B 21/154 248/222.41
5,163,260 A * 11/1992 Ricard ..... E06B 7/082 52/473
5,737,874 A * 4/1998 Sipos ..... E06B 9/02 49/63
6,421,966 B1 * 7/2002 Braunstein ..... E04F 10/08 136/244
6,536,174 B2 * 3/2003 Foster ..... E06B 9/02 49/463

(Continued)

*Primary Examiner* — Blair M Johnson

(57) ABSTRACT

A modular sun-shading system comprised of a plurality of latticed shading panels together with supporting rails and orthogonal brackets to provide substantially perpendicular mounting to a building structure outer wall above a window opening, providing a reduced heat load and reduced cooling expenses of a building by shading a building window opening and interior, while having latticed shading panels that allow for snow and rain to pass through and also having reduced wind dynamic drag.

11 Claims, 5 Drawing Sheets

(56) References Cited

U.S. PATENT DOCUMENTS 6,560,941 B1 * 5/2003 French ..... E06B 7/08 52/473
6,571,851 B1 * 6/2003 Jelic ..... E06B 9/262 160/107
6,732,475 B1 * 5/2004 Lee ..... E06B 7/09 49/505
6,810,620 B1 * 11/2004 Anderson ..... E06B 7/086 49/403
6,996,934 B2 * 2/2006 Briscoe ..... E06B 9/02 160/117
7,900,417 B1 * 3/2011 Leines ..... E04C 3/06 52/650.3
8,333,353 B1 * 12/2012 Silverman ..... F16M 11/041 24/331
8,336,270 B2 * 12/2012 Vagedes ..... E06B 9/04 52/455
2002/0054816 A1 * 5/2002 Bucher ..... F04D 25/088 416/210 R
2004/0037669 A1 * 2/2004 Bauer ..... F16B 21/09 411/523
2004/0187398 A1 * 9/2004 Schiedegger ..... E06B 9/04 52/73
2005/0076569 A1 * 4/2005 Griffiths ..... E06B 7/096 49/82.1
2006/0249260 A1 * 11/2006 Nien ..... A47H 13/00 160/84.03
2007/0176076 A1 * 8/2007 Logan ..... B28B 1/14 249/195
2008/0315063 A1 * 12/2008 Gallien ..... F16B 21/09 248/544
2013/0192770 A1 * 8/2013 Murphy, Jr. ..... E04F 10/10 160/5
2014/0027070 A1 * 1/2014 Birkestrand ..... E06B 9/36 160/168.1 V
2014/0262059 A1 * 9/2014 Gelsebach ..... E04F 10/02 160/22
2016/0053535 A1 * 2/2016 Birkestrand ..... E06B 9/364 160/218
2016/0076254 A1 * 3/2016 Wiborg ..... E04F 10/08 160/59

* cited by examiner

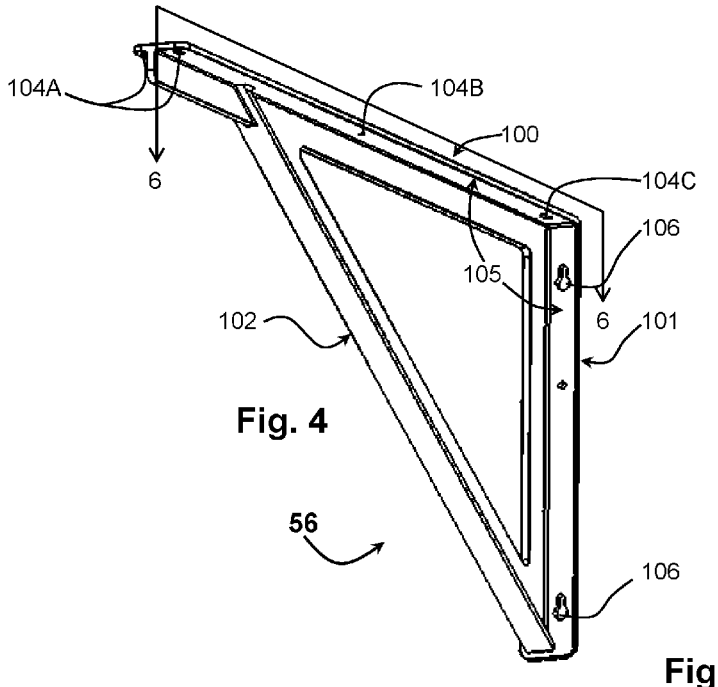
Fig. 4
Fig. 5
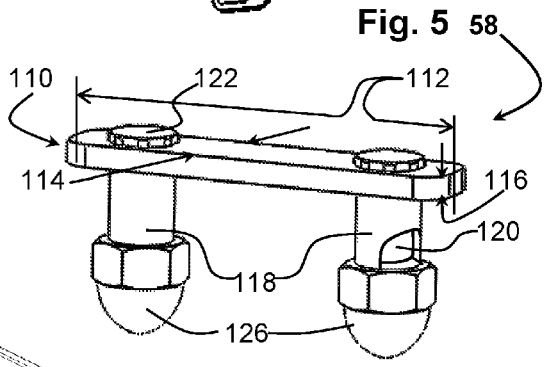
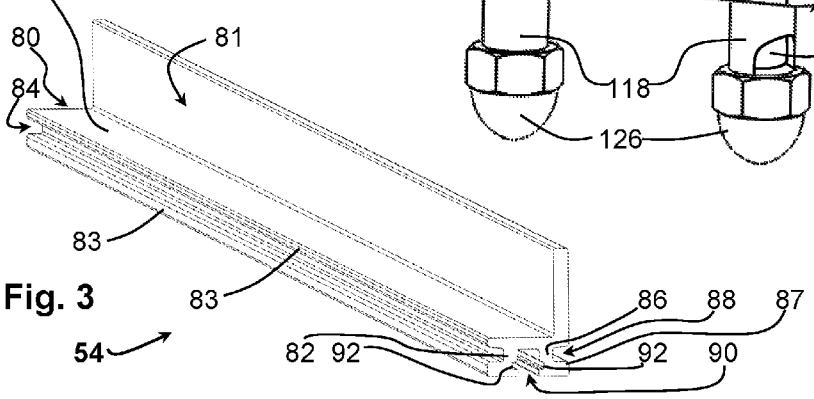
Fig. 3

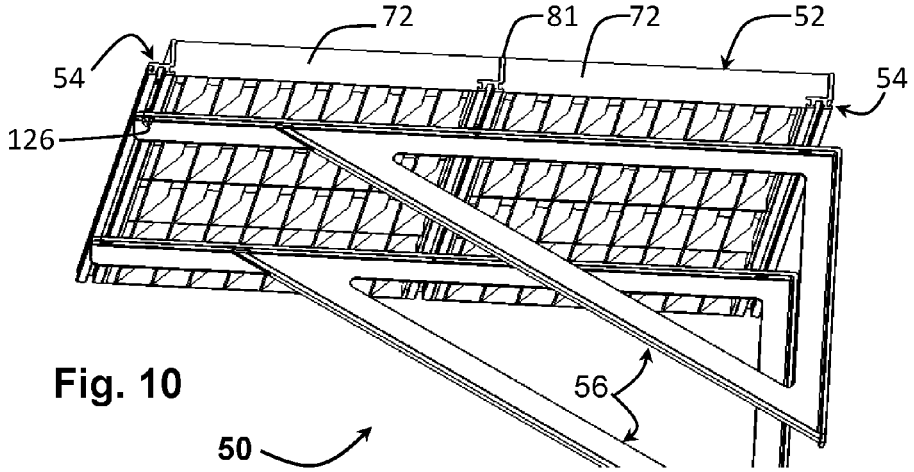
Fig. 10
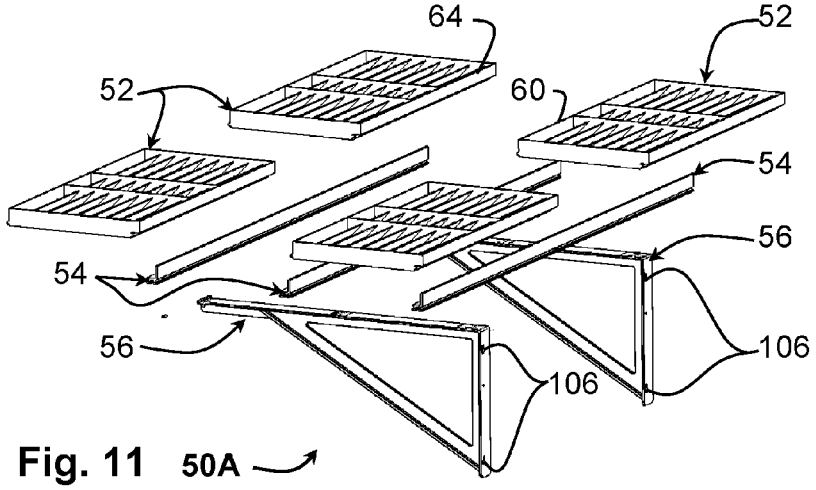
Fig. 11
Fig. 12
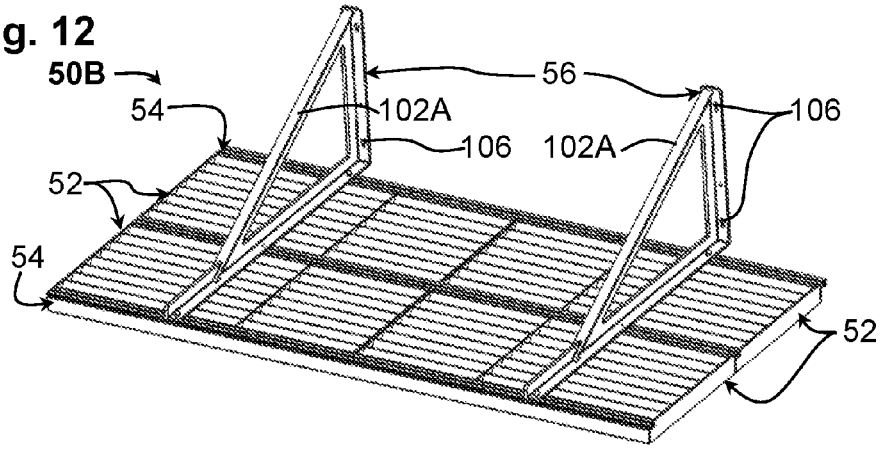

MODULAR, EASY-INSTALL WINDOW SHADING SYSTEM

FIELD OF INVENTION

The present invention relates to passive shading systems, in particular to passive sun shading systems which reduce buildings' energy cooling loads by eliminating direct sunlight into buildings.

BACKGROUND

In warm periods, air-cooling systems work to bring building temperatures to a comfortable level. These cooling systems are relatively inefficient and consume large amounts of energy to maintain the proper indoor temperature during warm periods. The amount of heat in the building that must be overcome is known as the heat load. The warmer it is outside and the less insulated a building is, the greater a heat load will typically be. The greater heat load results in more energy required to bring the indoor temperature of the building to a comfortable level.

Every window in a building adds to the heat load for several reasons. First, it has a low insulation value, so warm outdoor temperatures move fairly quickly indoors through windows, as opposed to walls. Second, windows often enable air to squeeze through small leaks, which also enable faster movement of warm air into buildings. Finally, another contribution to the heat load comes from the direct sun that shines through a window heats up the floor, walls, furniture, and other items in a building, which in turn heat the surrounding air. This is known as passive heating, or greenhouse effect, and is a substantial contributor to the cooling energy consumption during warm periods.

SUMMARY

The present invention provides a passive shading system, which is easy to install and modular in design. It dramatically reduces the direct sunlight, which passes through windows during the hottest months and the warmest times of the day. The invention does this through several key design features: (1) unique attachment features, which enables the installer to align and install the shading system accurately and quickly; (2) a unique modular design, which enables the shade to fit a wide range of window widths and heights with a simple and unique interlocking system; and (3) a unique structural design and material selection that enable stronger resistance to the environmental elements.

BRIEF DESCRIPTION OF THE DRAWING

These and further features of the present invention will be better understood when reading the Detailed Description, taken together with the drawing Figures, wherein:

FIG. 3 is a perspective view of an exemplary shading panel interlocking beam support member according to one embodiment of the present invention;

FIG. 4 is a perspective view of an exemplary mounting bracket accord to one embodiment of the present invention;

FIG. 5 is a perspective view of an exemplary fastener assembly according to the present invention;

FIG. 10 is further alternate perspective view of the embodiment of FIG. 1;

FIG. 11 an exploded view of the embodiment of FIG. 1; and

FIG. 12 a perspective view of an alternate embodiment of the present invention.

DETAILED DESCRIPTION

Figure 1:
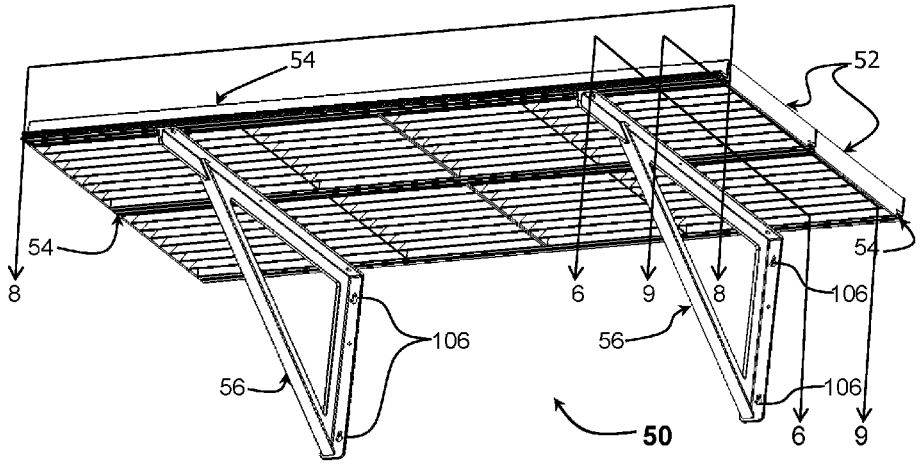
FIG. 1 is a perspective view of one embodiment of the present invention showing the lower sides of the shading panels supported by mounting brackets.

The shading system is designed with a unique mounting system, which enables easy installation and accurate adjustable mounting. As depicted in the embodiment 50 of FIG. 1, the mounting brackets 56 are designed with a slotted or elongated mounting holes 106 for easy installation on any type of window header and jambs or window frame. The mounting guide or support beam 54 assists in alignment and accuracy of drilling holes, while the slotted or elongated holes (e.g. 104A, 104C, FIG. 4) allows a margin of error in the exact locations. The mounting brackets 56 are then secured through tightening the screws down on the mounting bracket. The design enables a unique approach with greater flexibility in mounting to a window type, window frame, window trim and window size.

The shading system also has a unique design feature in its modular assembly and sizing approach. The shading system is design with a series of smaller, interlocking shade panels 52, e.g. as depicted in the FIGS. 6 and 10. This enables the user to use the same design for any size window that is being shaded. The user simply adds modules to make the appropriate size for the window. This modular design also creates a very easy packaging approach for even the largest of shading needs.

The unique modular design with modular panels 52 and rails or support beam 54 affixed to the support brackets 56 allows the system's supporting brackets 56 to be set apart from each other and secured at the locations needed for varying window widths.

The shading system 50 is designed with a latticed panel 52 structure, which keeps all light from passing through the shade, but reduces the overall weight substantially. This angled (74), latticed approach also enable water and snow to pass through the system, allowing it to be used in all inclement weather. Likewise the design approach ensures that strong winds will not create the strong lift that typically occurs from shading systems with greater continuous surface area. It is also made from durable UV stable plastics, which provides an inexpensive, easily fabricated, long-life product.

Figure 2:
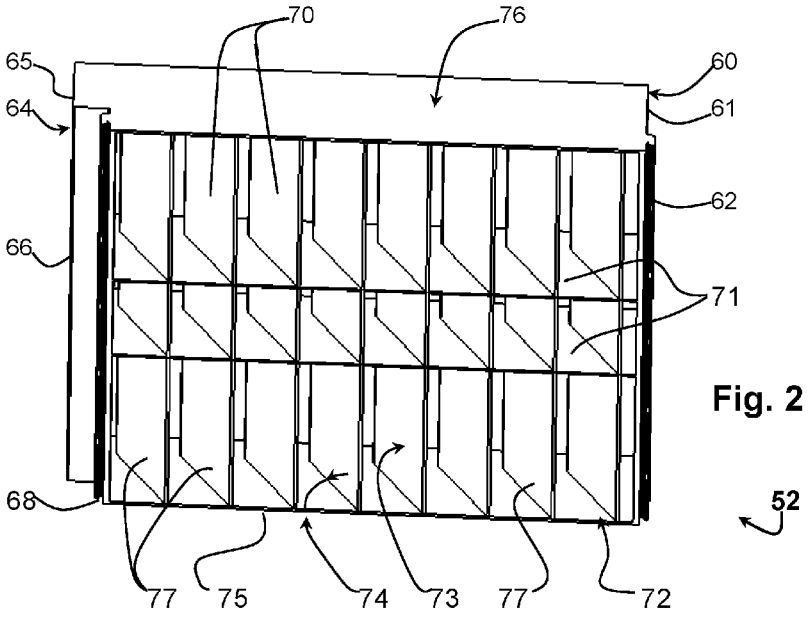
FIG. 2 is a plan view of a shading lattice panel according to one embodiment of the present invention laterally offset to show angle and attachment of the shading panel slats.

In the exemplary embodiment 50 shown in FIG. 1, the shading panels 52 seen in FIG. 2 comprise latticed panels substantially parallel disposed and spaced first and third end members 60, 64 connected by parallel disposed and spaced second and fourth end members 72, 76 to form a substantially planar rectangular area within which elongated substantially planar lattice members 70 extend between the second and the fourth end members and wherein the surface 73 of the lattice members 70 are angled toward (i.e. less than 90 degrees as shown in FIG. 2) the edge 75 of the shading panel 52. Intermediate support members 71 connected to first and third end members 60, 64 may also receive the planar members 70.

Also shown in FIG. 2 in latticed panel 52 are that first and third end members 60, 64 comprise substantially planar surfaces 61, 65 respectively, wherein third end member 64 includes an indented end portion 66, indented from the major portion of the end planar surface having a protruding member 68 extending therefrom. Similarly, the first end portion 60 comprises a planar surface including a protrusion 62 extending also outward therefrom, wherein protrusions 62, 68 comprise interlocking formations which interlock or mate with complementary formations (see FIG. 3) on the support beam(s) 54. According to one embodiment of the present invention, the first and third end members 60, 64 are formed to confront and engage mating members and surfaces (i.e. 80, 81, 82, 83, 84, 85, 86, 87, 88, FIG. 3).

The end member 62, 64, 72, 76 each comprise a length that define the shading area of the latticed panel 52, and each end member includes a thickness providing an edge such as the second end member edge 75, and each end member includes a width providing the thickness of the latticed panel. The latticed panel planar members 70 are typically connected to opposing (inner) surfaces of said first and third end members and are spaced apart relative to each other, and form an angle 74 between the planar surface 73 of the planar members 70 and the edge 75, shown in the exemplary embodiment as non-perpendicular, approximately 45 degrees.

Additional embodiments of the shade panel 52 assembly include adjustable lattice planar members 70 angles 74; thus in the colder months the lattice member 70 angle 74 could be such that it would allow for the sunlight to enter the windows. In yet another embodiment the support brackets 56 have adjustable horizontal angles (105, FIG. 4). This feature allows greater shade coverage of the windows for areas and times where the sun is approaching a horizon position being at a lower angle in the sky.

An alternate embodiment comprises several of the system assemblies may be vertically stacked to provide the desired shading at tall windows over six feet in height. For this embodiment, two assemblies or more depending on window height may be used to provide desired shading. For example, one unit may be installed at the (side) window jambs at the top of the window height and the second installed in the same manner at the window jambs at mid-height.

Another alternate embodiment 50B of FIG. 12 that may be provided as a modular kit-of-parts as described herein, which when assembled, address particular window structures, e.g. windows that do not have structural framing to affix the assembly support brackets at the sides of a window. For this condition the unit can be inverted as shown in FIG. 12. The assembly is then hung from the building structure above the window header by the support brackets 104. To retain the correct orientation of the sloped latticed panels 52 to provide the desired shading the supports are assembled at a 180 degree turned orientation from the typical assembly to support system beams (e.g. 50 in FIG. 1).

A further embodiment is the projection and cantilevered of the latticed panels 52 beyond the support brackets 56 that results in additional shading from the rising and setting Sun. With the typical installation of the support brackets 56 affixed to the window jambs (not shown), the side cantilevers of the shading system assembly project beyond the window opening.

A further embodiment is that the underside 77 of the sloped (74) planar lattice members 70 deflects artificial light pollution from the night sky.

A further embodiment comprises latticed panels made of metal that would strengthen the described assembly and its resistance to strong winds, snow and ice.

The design characteristics of the embodiments of the present invention provide a unique shading system that addresses problems that have been typical with various shading awning systems where they were difficult to install, had little or no design flexibility, and were very vulnerable to adverse weather conditions due to the large force generated by dynamic pressure of strong wind. For this reason, this unique shading system provides a more robust design that addresses several major problems with other designs.

Further detail of the support brackets 54 is shown in FIG. 4, wherein the bracket(s) comprise a generally horizontally extending member 100 and a generally vertically extending member 101 connected at one end of each, and a further diagonal member 102 connecting the members 100, 101 at a distance away from the connection of members 100, 101 to generally form a triangle with a portion of the horizontal member extending beyond where diagonal member 102 joins, forming a right (90 degree) angle 105 therebetween. Furthermore, the vertical and horizontal members 100, 101 shown in the exemplary embodiment comprises "T" shaped members, and include apertures thereon, including on the vertical member 101, elongated apertures 106 including an enlarged opening portion at one end thereof through which a fastening means head, e.g. of a screw or nail, extends and is retained by a structure wall (not shown) proximal to an opening thereof. The horizontal member 100 shown typically includes apertures therealong through which fasteners 58 are received to retain the support beams 54, and typically comprise an hole 104B, while providing elongated or slotted holes 104A, 104C on either side of hole 104B to provide motion (relative hole 104B) of the fastener due to thermal expansion/contraction of the latticed panels 52. Alternate embodiments provide different angles 105.

FIG. 1 shows complete assembly including four panels 52, two support brackets 56 and three horizontal support extrusions 54.

A single latticed shade panel 52 is shown in FIG. 2.

FIG. 3 shows one embodiment of an extruded beam support 54 that interlocks between the shade panels 52 and provides added vertical support with planar edge 81 extending generally perpendicular from the beam support 54 horizontal surface 85 and is captured between shade panels 52 when each is seated in a common beam support 54. For larger width of windows the extruded support beams planar edge can be increased in height to further increase vertical section modulus and stiffness.

The support beam 54 is shown in greater detail in FIG. 3 in an exemplary orientation showing a generally rectangular cross section horizontal portion 80 having three recesses there in and a portion 81 generally perpendicular to the surface 85 of the portion 80, having a surface to confront and mate with surface 65 of latticed panel 52 (and an opposite surface that confronts and mates with surface 61 of another latticed panel 52). Opposing surfaces 83 and 87 of the rectangular portion 80 each include a corresponding recess 84 and 88 which are formed to receive protrusions 68, 62 of the latticed panel 52 (also FIGS. 6, 7). A third recess 90 is formed in the remaining part of the rectangular portion 80 generally between the recesses 84, 88 to form a channel extending toward the surface 85 to receive a portion of the fastener 58 (FIG. 5), and the recess 90 has two recesses 92 on opposing walls thereof to receive a planar link (110, FIG. 5) of the fastener 58. According to the exemplary embodiment of the drawing figures, the support beam horizontally retains and connects panels 52 and together with fastener 58, retains the latticed panels vertically with respect to the support brackets 54, and to provide support relative to the support brackets 56.

A support bracket 54 and mounting holes 106 is shown in FIG. 4. Mounting brackets 56 also have three locations for attaching panels holding beams: a middle hole 104B while front 104A and back 104C holes are slots. The slots are needed and shaped (e.g. elongated) to accommodate thermal expansion of the panels 52.

Further detail of the support brackets 54 is shown in FIG. 4, wherein the bracket(s) comprise a generally horizontally extending member 100 and a generally vertically extending member 101 connected at one end of each, and a further diagonal member 102 connecting the members 100, 101 at a distance away from the connection of members 100, 101 to generally form a triangle with a portion of the horizontal member extending beyond where diagonal member 102 joins, forming a right (90 degree) angle therebetween. Furthermore, the vertical and horizontal members 100, 101 typically comprises "T" shaped members, and include apertures thereon, including on the vertical member 101, elongated apertures 106 including an enlarged opening portion at one end thereof through which a fastening means head, e.g. of a screw or nail, extends and is retained by a structure wall (not shown) proximal to an opening thereof. The horizontal member 100 shown typically includes apertures therealong through which fasteners 58 are received to retain the support beams 54, and typically comprise an hole 104B, while providing elongated or slotted holes 104A, 104C on either side of hole 104B to provide motion (relative hole 104B) of the fastener due to thermal expansion/contraction of the latticed panels 52. Alternate embodiments provide different support bracket angles 105.

FIG. 5 shows a fastener assembly 58 that are used to attach the support beams 54 (and therefore the panels 52) to the mounting brackets 56. In this embodiment the fastener assembly 58 contains self-clinching threaded studs 120 along with spacers 118 (in partial cutaway to show stud 120) and closed nuts 126 disposed on the studs 120. The function of the spacers is to maintain precise specific distance between the fastener head 122 and the nut 126.

Figure 6:
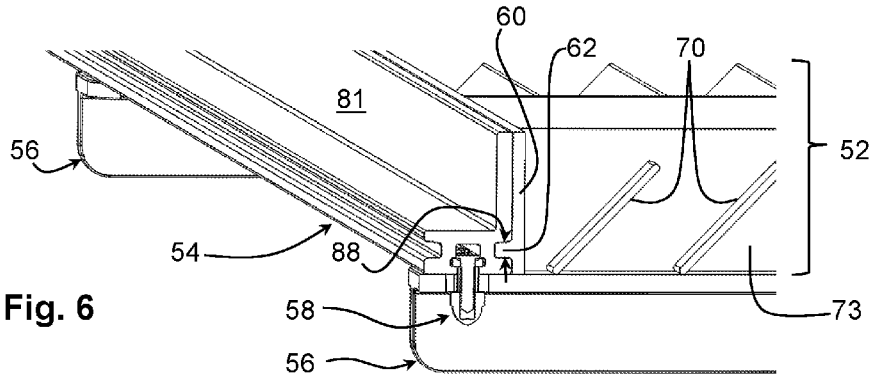
FIG. 6 is a perspective view in partial cut-away of an assembly of the lattice panel of FIG. 2, the beam support of FIG. 3, the mounting bracket of FIG. 4 and the fastener assembly of FIG. 5.

A cross section of the mounting bracket 54 with a mounting slot 90 described above in FIG. 3 and fastener assembly 58 received in the mounting slot 90 is shown in FIG. 6. The fastener assembly 58 attaches the parts while allowing for appropriate thermal expansion or contraction of the materials due to changing temperatures. In one of the embodiments it is achieved by using a spacer 118 dimensioned to preclude complete clamping of the parts (54, 56) by tightening the fastener assembly nuts 126 on respective threads 124.

A further cross section of the beam support 54 mounted onto the support bracket 56 with slotted hole 104A for panel's thermal expansion while interlocking the beam support 54 to the shade panel 52 with protrusion 62 retained by beam support 54 recess 88. The interlocking design according to the present invention enables the support beams 54 to move relative to the support brackets 65 due to panel expansion and contraction.

Figure 7:
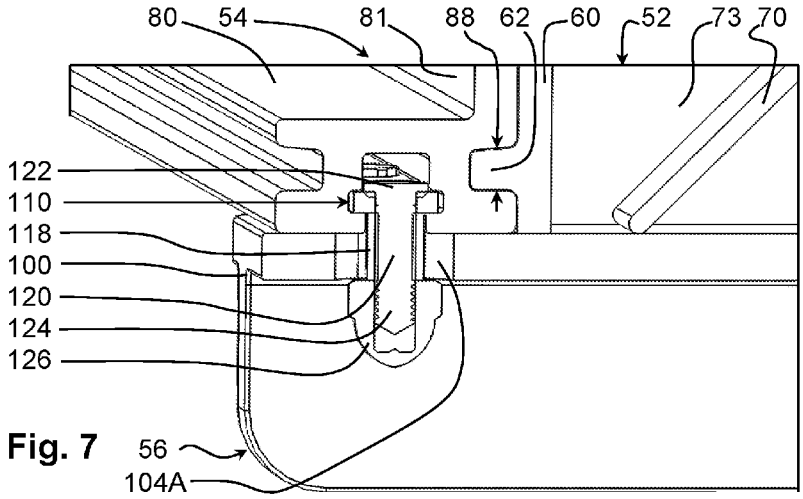
FIG. 7 is an enlarged perspective view of a portion of the assembly of FIG. 6.

A typical fastener 58 and relationship to latticed panels 52 and support bracket 56 shown in FIGS. 5-7, provides two bolts 120 typically including a shank 122, head 122 and threads 124 are held in a generally parallel position by extending through a planar link having a length 112, width 114 and thickness 116 (retained within slots 92 of support beam 54). The shank 122 receives a spacer 118 thereover and is retained by a nut 126 applied to the bolt 120 threads 124. The advancement of the nut 126 on the threads (and thus the distance between the nut 126 and planar link 110) is defined (i.e. limited) by the spacer 118 and provides freedom of motion to accommodate thermal expansion or contraction.

Figure 8:
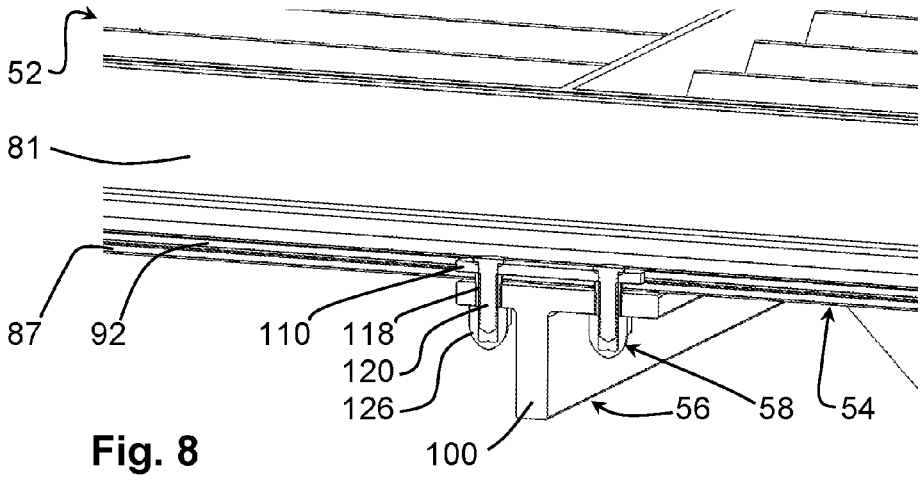
FIG. 8 is an alternate perspective view in partial cut-away of an assembly of the lattice panel of FIG. 2, the beam support of FIG. 3, the mounting bracket of FIG. 4 and the fastener assembly of FIG. 5 perpendicular to the view of FIG. 6.

A fastener assembly 58 cross-section in the direction orthogonal to an axis passing through both bolts 120 is shown in FIG. 8.

Also as shown in the exemplary embodiment of the drawing figures and in FIG. 8 in particular, the support bracket comprises a "T" shape, and the planar link 110 is dimensioned to allow a bolt 120 to extend through a different side of the top of the "T"-shaped support bracket 56 holes (e.g., 104A) and be retained thereto. The bolts 120 (with spacer 118) extending through pairs of slotted or elongated holes (e.g. 104A, 104C) are permitted horizontal motion relative to the support bracket to accommodate thermal expansion/contraction. Furthermore, the planar link 110 is slidable the length of the support beam 54 within the recesses 92 to facilitate assembly and adjustment.

An end section isometric drawing of an exemplary structure according to the present invention having with three beam supports 54 extending along a direction of the attached widow (not shown) width.

FIG. 10 shows side view of the complete assembly 50 according to one embodiment of the present invention.

Figure 9:
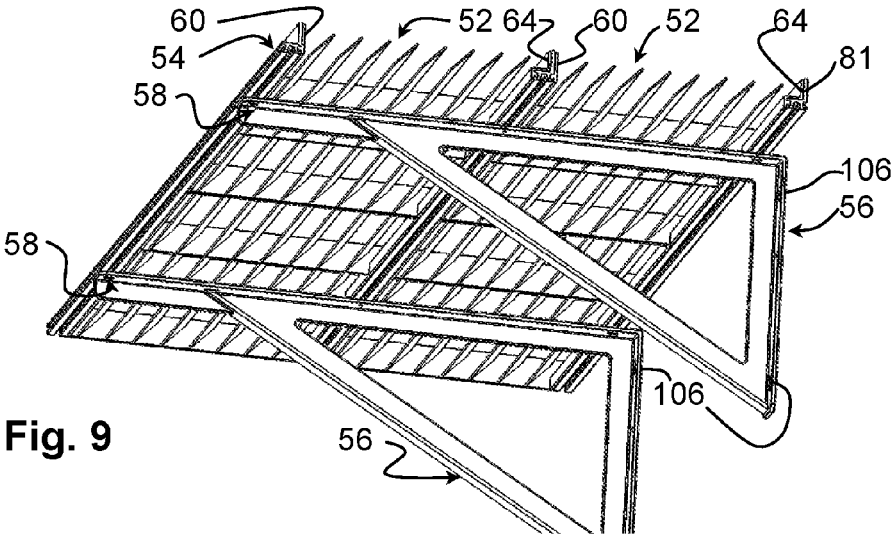
FIG. 9 is an alternate perspective view of FIG. 1, in partial cut-away of the shading lattice and beam support.

The perspective views of FIGS. 9, 10 from below of a typical deployment of the system according to one embodiment of the present invention shows panels 52 disposed on the support brackets 56 to be cantilevered beyond the support brackets. FIG. 9 shows a cut away revealing the angled disposition relative to the support bracket 56 of the latticed panel 52 planar members 70, and FIG. 10 shows the support beam 54 portion 81 sandwiched between surfaces 60, 64 of adjoining latticed panels 52.

An exploded axonometric view 50A of the assembly according to one embodiment of the present invention is shown in FIG. 11 that includes four latticed shade panels 52, however the assembly 50A can be expanded to six or more panels 52 in either horizontal direction thus blocking larger area of sunlight, covering larger size windows. The beam supports 54 vertical extension (81) can be increased in height to accommodate increasing rigidity and strength for length of the assembly 50A (larger size windows).

An exploded view of multiple latticed panels 52, support beams 54 and support panels 56 of a cantilevered embodiment 50A shown in FIG. 11, also shows the relationship of end member surfaces 60, 64 and corresponding support beams 54.

FIG. 12 shows an alternate complete assembly 50B including four panels 52, two support brackets above the shade panels 52, and three horizontal support extrusions 54 providing an inverted orientation that may be implemented when there is no building structural members at the sides of the window for mounting like at a continuous run of ribbon windows or storefront glazing system. Instead, this alternate system assembly 50B orientation may be hung from the building structure (not shown) above the window header.

This alternate assembly 50B requires the supports 56 to be at a 180 degree turned orientation from support beams 54 of the typical assembly when supported from below so that the orientation of the sloped lattice panel 52 modules prohibits sunlight from passing through to the window. The same system holes 104B and slotted holes 104A, 104C are used for fastening connections of assembled members 54, 56.

The inverted deployment of the system 50B according to the present invention shown in FIG. 12 having the latticed panels 52 and connecting support beams 54 reoriented relative to the support brackets 54 to accommodate suspension by the support brackets from above while providing the same general latticed panel 52 planar member 70 angular orientation relative to a building outer surface (not shown) to which the system 50B may be attached. The openings 106 of this embodiment have not been similarly inverted relative to the vertical member 102A.

To review, an exemplary embodiment of the present invention comprises a modular expandable shading system that features angled latticed panels supported by custom shaped rails and brackets, is easily installed and adapted to fit any size window. Furthermore, the modular expandable shading system of the exemplary embodiment can additionally include slotted shading latticed panels that enable shading while allowing snow, rain and wind to pass through without affecting their structural integrity. A further feature of the exemplary embodiment of the modular expandable shading system includes a slotted interlocking supporting rails and brackets and mating panel to enable easy installation above window, requiring only standard tooling. Another feature of the exemplary embodiment of the modular expandable shading system has rail slides contain slotted continuous slides to enable horizontal adjustment above window to locate shade in optimal location and may also include slotted installation rails, which enable adjustment at any time after installation. Furthermore, the exemplary embodiment slotted rail system can be disposed to ensure flexible alignment adjustment with windows, which can vary in dimensions, enabling accommodating of window uniqueness without requiring custom modifications. Additional features of the exemplary embodiment include a rail and mounting bracket rail system that enables attachment to any kind of window design.

The latticed panel of the modular expandable shading system of the exemplary embodiment can be designed in various angles to accommodate window facing directions, as well as various climate needs, such as deeper angles for areas where snow load can be more substantial. Furthermore, the rail and mounting brackets of the modular expandable shading system of the exemplary embodiment can include a simple sliding bolt mechanism, which attaches the system in place when it is tightened, yet allows for long parts thermal expansion/contraction due to changes in temperature, and the parts of the modular expandable shading system may be made of a wide range of materials, including plastic and metal. Also, further features of the mounting bracket of the modular expandable shading system of the exemplary embodiment comprises a slotted configuration to enable the shade system to be removed during winter months without removing the mounting brackets, be disposed to provide additional shading from the rising and setting sun by the side cantilevers of the system assembly that project beyond the support brackets and window opening, and/or to provide an alternate configuration assembly of the system kit-of-parts that affords the system to be hung from above the window header.

What is claimed is:

1. A modular expandable shading system comprising:

a plurality of latticed panels, each of said plurality of latticed panels having a plurality of end surfaces defining an area disposed over a plane and having a thickness, and a first interlocking formation on at least one of said end surfaces, and a plurality of elongated planar members supported by said end surfaces at an angle relative to said plane;

an elongated support beam having a length complementary to one of the latticed panel end surfaces including an outwardly extending member having a surface disposed to engage said one end surface, and a second interlocking formation disposed on said support beam to engage and retain said first interlocking formation in at least one dimension and formed to allow movement of said first interlocking formation along said elongated support beam;

an elongated support bracket attached to and disposed perpendicularly to said elongated support beam; and a fastener extending from said elongated support beam and through said elongated support bracket to substantially retain said elongated support beam and said elongated support bracket in a 3-dimension relationship, wherein said first interlocking formation and said second interlocking formation retains said plurality of latticed panels in a 3-dimensional relationship.

2. The modular expandable shading system of claim 1 wherein said plurality of elongated planar members are spaced relative to each other.

3. The modular expandable shading system of claim 1 wherein said elongated support beam includes a slot therein adapted to receive an end of said fastener.

4. The modular expandable shading system of claim 1 wherein elongated support bracket includes openings to receive said fastener therethrough and permit movement of said fastener along said fastener length.

5. The modular expandable shading system of claim 1 wherein said angle of said planar members is approximately 45 degrees.

6. The modular expandable shading system of claim 1 wherein said support bracket includes a horizontal surface receiving said support beam and said latticed panel thereon and a vertical surface including an aperture through which a mounting device is receivable to enable the support bracket to be mounted to a vertical surface.

7. The modular expandable shading system of claim 1 comprising a plurality of support bracket disposed parallel relative to each other, and wherein at least one of said latticed panels are disposed to include a portion thereof to extend away from, and have cantilevered support from said plurality of support brackets.

8. A modular expandable shading system comprising:

a plurality of latticed panels, each of said plurality of latticed panels having a plurality of end surfaces defining an area disposed over a plane and having a thickness, and a first interlocking formation on at least one of said end surfaces, and a plurality of elongated planar members supported by said end surfaces at an angle relative to said plane;

an elongated support beam having a length complementary to one of the latticed panel end surfaces including an outwardly extending member having a surface disposed to engage said one end surface, and a second interlocking formation disposed on said support beam to engage and retain said first interlocking formation in at least one dimension and formed to allow movement of said first interlocking formation along said elongated support beam;

an elongated support bracket attached to and disposed perpendicularly to said elongated support beam; and a fastener extending from said elongated support beam and through said elongated support bracket to substantially retain said elongated support beam and said elongated support bracket in a 3-dimension relationship, wherein said first interlocking formation and said second interlocking formation retains said plurality of latticed panels in a 3-dimensional relationship, wherein said elongated support beam includes a slot therein adapted to receive an end of said fastener, and said elongated beam support slot extends along said length thereof to enable horizontal adjustment of said elongated support beam relative to said elongated support bracket.

9. A modular expandable shading system of comprising:

a plurality of latticed panels, each of said plurality of latticed panels having a plurality of end surfaces defining an area disposed over a plane and having a thickness, and a first interlocking formation on at least one of said end surfaces, and a plurality of elongated planar members supported by said end surfaces at an angle relative to said plane;

an elongated support beam having a length complementary to one of the latticed panel end surfaces including an outwardly extending member having a surface disposed to engage said one end surface, and a second interlocking formation disposed on said support beam to engage and retain said first interlocking formation in at least one dimension and formed to allow movement of said first interlocking formation along said elongated support beam;

an elongated support bracket attached to and disposed perpendicularly to said elongated support beam; and a fastener extending from said elongated support beam and through said elongated support bracket to substantially retain said elongated support beam and said elongated support bracket in a 3-dimension relationship, wherein said first interlocking formation and said second interlocking formation retains said plurality of latticed panels in a 3-dimensional relationship, wherein said elongated support beam includes an elongated slot, and said fastener comprises an retainer elongated in a first direction and having a width perpendicular to said fastener first direction engaging said elongated support beam elongated slot and slidable therealong, and a bolt extending through said retainer and outward from said elongated slot substantially perpendicular to said retainer, and wherein said bolt includes a nut that together with said retainer, is adjustable to urge said support beam and said support bracket together.

10. The modular expandable shading system according to claim 9, further including a spacer disposed on said bolt between said nut and said retainer to define a distance between said nut and retainer to allow for thermal expansion and contraction of said elongated support beam, elongated bracket and latticed shading panel.

11. A modular expandable shading system comprising:

a latticed panel having a plurality of end surfaces defining an area disposed over a plane and having a thickness, and a first interlocking formation on at least one of said end surfaces, and a plurality of elongated planar members supported by said end surfaces at an angle relative to said plane;

an elongated support beam having a length complementary to one of the latticed panel end surfaces including an outwardly extending member having a surface disposed to engage said one end surface, and a second interlocking formation disposed on said support beam to engage and retain said first interlocking formation in at least one dimension and formed to allow movement of said first interlocking formation along said elongated support beam;

an elongated support bracket attached to and disposed perpendicularly to said elongated support beam; and a fastener extending from said elongated support beam and through said elongated support bracket to substantially retain said elongated support beam and said elongated support bracket in a 3-dimension relationship, wherein said first interlocking formation and said second interlocking formation retains said latticed panel in a 3-dimensional relationship.

* * * * *